US006709375B2

(12) United States Patent
Groenenberg et al.

(10) Patent No.: US 6,709,375 B2
(45) Date of Patent: Mar. 23, 2004

(54) METHOD AND APPARATUS FOR CREASING A PRODUCT FOLDED ALONG A FOLD LINE

(75) Inventors: Cornelis Jacobus Groenenberg, Venlo (NL); Maurice Johan Marie Bindels, Eindhoven (NL)

(73) Assignee: Oce-Technologies B.V., Venlo (NL)

( * ) Notice: Subject to any disclaimer, the term of this patent is extended or adjusted under 35 U.S.C. 154(b) by 0 days.

(21) Appl. No.: 09/908,806

(22) Filed: Jul. 20, 2001

(65) Prior Publication Data

US 2001/0044366 A1 Nov. 22, 2001

Related U.S. Application Data

(63) Continuation of application No. 09/276,723, filed on Mar. 26, 1999.

(30) Foreign Application Priority Data

Mar. 27, 1998 (NL) ..... 1008727

(51) Int. Cl.[7] ..... B31F 1/10

(52) U.S. Cl. ..... 493/442; 493/360; 493/144; 493/435

(58) Field of Search ..... 493/406, 360, 493/407, 442, 144, 454, 435

(56) References Cited

U.S. PATENT DOCUMENTS

| | | | | |
|---|---|---|---|---|
| 648,004 | A | 4/1900 | Van Dercar | 493/471 |
| 1,001,443 | A | 8/1911 | Rand | 493/406 |
| 1,293,339 | A | 2/1919 | Clauss | 493/325 |
| 1,785,991 | A | 12/1930 | Wilhelm | 493/324 |
| 3,008,709 | A | 11/1961 | Buslik | |
| 3,340,131 | A | 9/1967 | Leibow | 100/176 |
| 3,580,562 | A | 5/1971 | Reist | 270/54 |
| 3,855,917 | A | 12/1974 | Farrell et al. | 100/176 |
| 3,931,963 | A | 1/1976 | Bewersdorf | 270/61 |
| 4,595,187 | A | 6/1986 | Bober | 270/373 |
| 5,259,825 | A | 11/1993 | De Angelis et al. | 493/144 |
| 5,520,604 | A | 5/1996 | Reist | 493/422 |

FOREIGN PATENT DOCUMENTS

| | | | |
|---|---|---|---|
| EP | 2023387 | 11/1971 | 412/22 |
| EP | 2430114 | 1/1975 | 412/22 |
| EP | 2618258 | 1/1977 | 493/270 |
| EP | 0034921 | 9/1981 | |
| EP | 0748756 | 12/1996 | |

*Primary Examiner*—Eugene Kim
*Assistant Examiner*—Sameh H. Tawfik
(74) *Attorney, Agent, or Firm*—Birch, Stewart, Kolasch & Birch, LLP

(57) ABSTRACT

A creasing device for creasing a folded booklet on its fold line utilizing two creasing rollers which together form a creasing nip for rolling over the fold line of the booklet, the creasing nip pressing the booklet flat during a reciprocating movement of the creasing nip. During the creasing cycle, the booklet is enclosed on its fold line between two guide strips which extend between the creasing rollers and extend over the line of movement of the creasing nip.

8 Claims, 4 Drawing Sheets

METHOD AND APPARATUS FOR CREASING A PRODUCT FOLDED ALONG A FOLD LINE

This application is a continuation continuation-in-part of co-pending application Ser. No. 09/276,723, filed on Mar. 26, 1999, the entire contents of which are hereby incorporated by reference and for which priority is claimed under 35 U.S.C. § 120; and this application claims priority of Application No. 1008727 filed in The Netherlands on Mar. 27, 1998 under 35 U.S.C. § 119.

BACKGROUND OF THE INVENTION

The present invention relates to a method of creasing a product folded along a fold line, wherein a creasing nip which is formed on the fold line is moved along the fold line over the folded product in order to flatten the folded product.

A general method of this kind is known from U.S. Pat. No. 5,520,604. According to the method described therein, two creasing nips are disposed next to one another in the middle of the fold line and then moved away from one another along the fold line, each to a different end thereof.

A disadvantage of this method is that the creasing nips do not cover the entire length of the fold line because they cannot be operative between the places where the creasing nips are initially disposed. Due to the absence of a creasing action in the middle of the folded product, the latter can still gape open after the creasing operation, and this can cause problems in connection with the formation of a straight stack of folded products.

Although U.S. Pat. No. 3,931,963 discloses rolling a creasing nip over a folded product along the entire fold line, in this known method, the folded product consists of a single sheet which acts as a cover for a pack of sheets.

SUMMARY OF THE INVENTION

Accordingly, the object of the present invention is to provide a method according to the preamble without the above disadvantage and without being restricted to creasing a single folded sheet.

To this end, according to the present invention, the creasing nip is moved successively in opposite directions along the fold line over the folded product.

As a result a number of sheets double folded together is pressed flat without the sheets of the pack of sheets pressed flat on the fold line being shifted in the direction in which the creasing nip moves over the folded pack. The latter occurs if a nip is moved over a pack of sheets as explained in U.S. Pat. No. 3,008,709.

Since, according to the present invention, the creasing nip is successively moved in opposite directions over a pack of sheets, the sheet shift produced on movement in one direction is cancelled by a shift produced on movement in the opposite direction.

The present invention also relates to a device for performing the method described hereinbefore, comprising nip-forming means for forming the creasing nip on the fold line and transport means for producing a relative movement between the formed creasing nip and the folded product, wherein the transport means are provided with reversing means which, after displacement of the creasing nip along the fold line in one direction, the creasing nip is displaced in the opposite direction along the fold line.

As a result, a simple embodiment is obtained which can be disposed directly after a device in which the product is folded along a fold line by folding rollers, the folded product being held fast by the folding rollers during the creasing operation.

An advantageous embodiment of a device in which the creasing nip is formed by a pair of rollers for creasing a product folded along a fold line, comprises two fixed guide strips which extend between the nip-forming roller pair along the fold line, the folded product being adapted to be brought with its fold line between the two guide strips. As a result, a number of double folded sheets creased on the fold line cannot readily shift in the transverse direction with respect to the fold line.

In addition, the guide strips are practically immovable in the creasing nip in a direction parallel to the direction in which the axis of the nip-forming roller extends and movable in a direction perpendicular to the flat plane traversed by the creasing nip. As a result, folded products of different thicknesses can be brought between the guide plates without the guide plates being able to shift in the creasing nip plane and thus affecting the fold quality.

In another advantageous feature of the device according to the present invention, the guide strips form an acute angle with the direction of the axis of the nip-forming roller in the direction in which the axis of the nip-forming roller extends. As a result, a folded pack of sheets can readily be fed into the funnel formed between the guide plates and be already flattened to some extent before entering the creasing nip.

If the guide strips in a direction in which the creasing nip is displaceable has a first dimension larger than the longest fold line of a folded product for creasing and if the maximum distance over which the creasing roller is adapted to roll over the guide strip corresponds to said first dimension, a gradual transition is obtained between the creasing nip outside a product for creasing and inside the same, so that there is no adverse collision at the start of the reciprocating stroke of a creasing cycle, which collision could damage the folded product.

BRIEF DESCRIPTION OF THE DRAWINGS

Other features and advantages of the present invention will be explained hereinafter with reference to the accompanying drawings wherein.

DETAILED DESCRIPTION OF THE INVENTION

Figure 1:
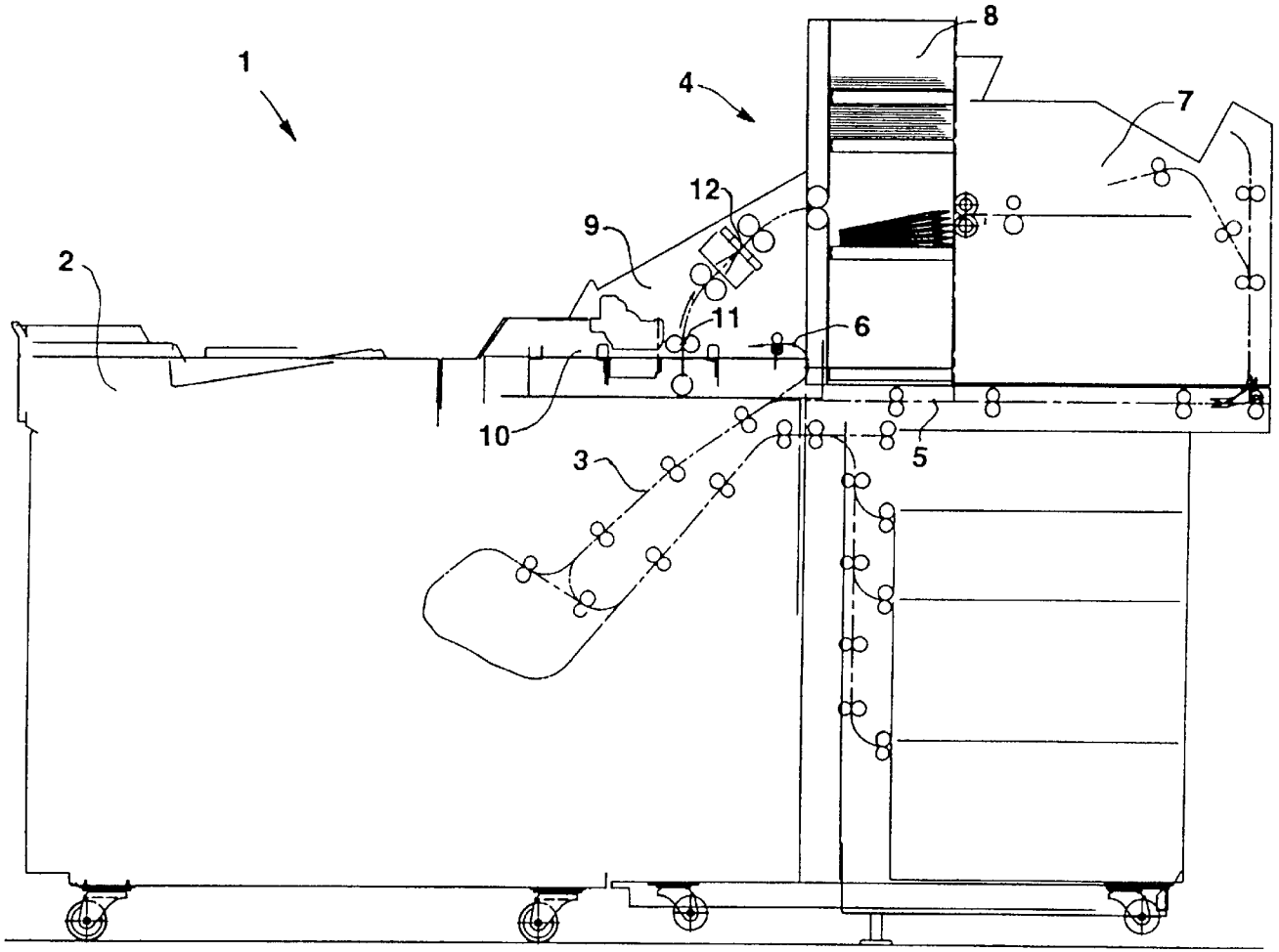
FIG. 1 shows a printing device for printing and folding booklets provided with a device for creasing said folded booklets on their fold line.

The printing apparatus 1 shown in FIG. 1 comprises a printing section 2, denoted by peripheral lines, in which sheets of receiving material can be printed on both sides with two images disposed next to one another. The printing apparatus 1 is provided with a sheet transport path 3 for the transport of sheets thus printed with four images from the printing section 2 to a sheet finishing station 4 disposed at the top of the printing section 2. The sheet transport path 3 divides into a path 5 and a path 6. Path 5 is used for the transport of sheets printed with an image on each side, and which do not need to be folded together but rather are to be bundled individually by the application of a staple in stapling station 7 and then delivered to delivery station 8. Path 6 serves for transporting sheets printed with two images on each side to a folding and creasing device 9. In the creasing and folding device 9 a number of sheets can be collected at a collecting station 10 and then can be double folded together in a folding nip 11 and finally pressed flat in a creasing station 12. Folded booklets pressed flat in this way can be easily stacked in delivery compartments of delivery station 8 without the stack height becoming unduly high.

Figure 3:
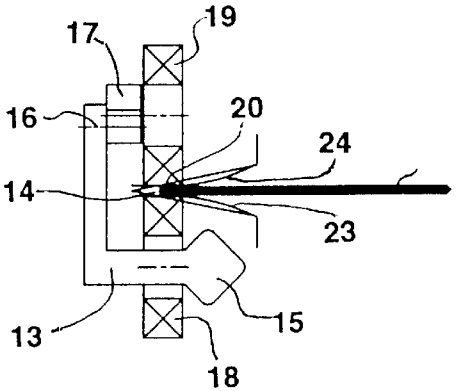
FIG. 3 is a cross-section of the creasing device shown generally in FIG. 1.
Figure 2:
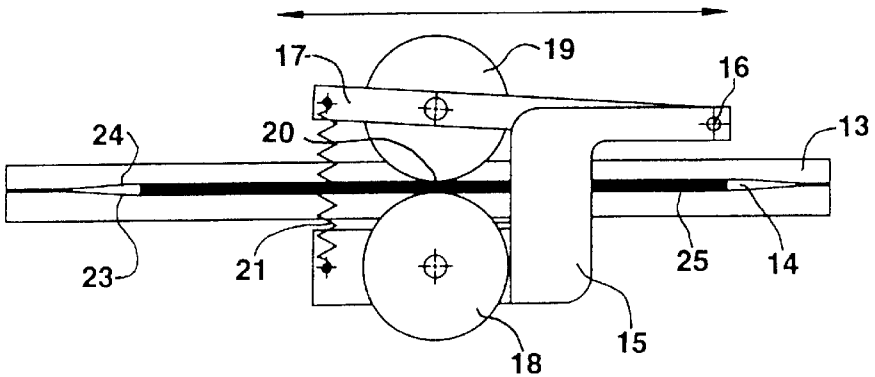
FIG. 2 is a longitudinal section of the creasing device shown generally in FIG. 1.

The creasing station 12 shown in detail in FIGS. 2 and 3 comprises a frame 13 which extends transversely over a transport path 14 for folded booklets. The frame 13 is provided with a transversely extending guide path in which a slide 15 is adapted to reciprocate in the directions shown by the arrows in FIG. 2. The slide 15 is provided with a pivot 16 which extends transversely to the direction of movement of the slide 15. An arm 17 is fixed to pivot about the pivot 16. A roller 18 is rotatably fixed on the slide 15 and a roller 19 is rotatably fixed on the arm 17. The rollers 18 and 19, the center-line of which extends in a direction transversely to the direction of movement of the slide 15, together form a creasing nip 20 with a nip force of a magnitude defined by a tension spring 21 which pulls the arm 17 in the direction of the slide.

Frame 13 is also provided with two elongate flexible strips 23 and 24 which form a funnel-shaped guide path for guiding a folded booklet 25 which is conveyed with its fold line at the front in the direction of the creasing station. Considered in the direction of transport of a folded booklet for creasing, longitudinal edges of strips 23 and 24 are respectively situated upstream of the creasing station at some distance below and above the transport path 14. At the creasing station, in the trajectory of the creasing nip 20, the other longitudinal edges of the strips 23 and 24 press against one another. To crease a folded booklet 25, the booklet is pushed between the strips 23 and 24 until it is in the trajectory of the creasing nip 20, with the strips 23 and 24, which are lightly pressed against one another at the creasing station, already pressing the folded booklet 25 flat to some extent. During the insertion of the booklet, the creasing rollers 18 and 19 are in an initial position outside the transport path 14 of the booklet. After the positioning of a folded booklet, with its fold line on the creasing station, the slide 15 is moved to and from, one time, along the guide path. Under these conditions, creasing roller 18 moves over strip 23 and creasing roller 19 over strip 24 so that the creasing nip 20 performs a reciprocating movement over the fold line of the booklet 25. On the return of the slide 15 to its initial position, the booklet 25, pressed flat along the fold line, is carried on further in the transport path 14 and delivered to one of the delivery compartments of the delivery station 8.

On movement of the creasing nip 20 over the folding edge of a number of sheets folded double together, there is a mutual shift of the sheets in the direction in which the creasing rollers move over the sheets. This shift is a result of the pressing-in experienced by the outermost sheets of the folded booklet at the site of the creasing nip. During this pressing-in, the outermost sheet follows the curvature of the adjoining creasing roller surface, while the more inwardly situated sheets experience an ever-decreasing curvature at the site of the creasing nip because they are increasingly less influenced by the curvature of the creasing rollers. As a result of this difference in curvature experienced by the outermost sheets of the folded booklet as a result of the creasing nip, there is a shift of these outermost sheets when the creasing rollers roll over the fold edge. The direction of this shift is dependent on the displacement of the creasing nip and the degree of shift is dependent on the applied nip pressure and the distance travelled by the creasing nip over the fold edge.

According to the present invention, a booklet pressed flat without sheets mutually shifted at the fold edge is obtained by first moving the creasing rollers in one direction over the fold edge of a number of sheets double folded together (during which a mutual shift of the outermost sheets occurs) and by then moving the creasing rollers in the reverse direction again over the fold edge (during which the outermost sheets again shift, but then in the opposite direction), the end result being that the sheets resume their original unshifted position.

The guide strips 23 and 24 ensure that during the reciprocating movement of the creasing nip the booklet clamped between the strips cannot readily move in the plane in which the booklet is situated. As a result of the stiffness of the guide strips and their fixing close to the plane in which the booklet is situated, the booklet experiences only a nip force occurring as a result of the strips being pressed in at the site of the nip, and hardly experiences forces operative in the plane of the booklet. By clamping the booklet rigidly during the creasing operation, the result achieved is that when the fold line is not exactly parallel to the line along which the creasing nip moves (for example because the booklet has been fed somewhat skewed), forces generated in a direction extending transversely of the fold line are taken by the guide strips 23 and 24 and are not transmitted to the booklet. This prevents the double-folded sheets from experiencing, during the creasing of the fold edge, forces which would press the sheets further together at their fold edge, something which might cause the folds of inner sheets being inwardly deflected.

Because the guide strips have a length greater than the length of the longest fold edge of a booklet for folding and the creasing rollers 18 and 19 in their inoperative position press against the guide strips 23 and 24 outside the transit zone of a booklet, the creasing rollers 18 and 19 have a gradual transition between the zone where the creasing rollers 18 and 19 press the strips directly against one another and a zone intermediate this in which a booklet extends between the guide strips 23 and 24. As a result of the presence of the guide strips 23 and 24 between the creasing rollers 18 and 19 and a booklet for creasing, which in extension of the fold edge project beyond the booklet, the creasing rollers 18 and 19 are prevented, at the start of the creasing operation, from colliding directly against a side edge of the booklet for creasing, something which might cause damage to the booklet.

Figure 4:
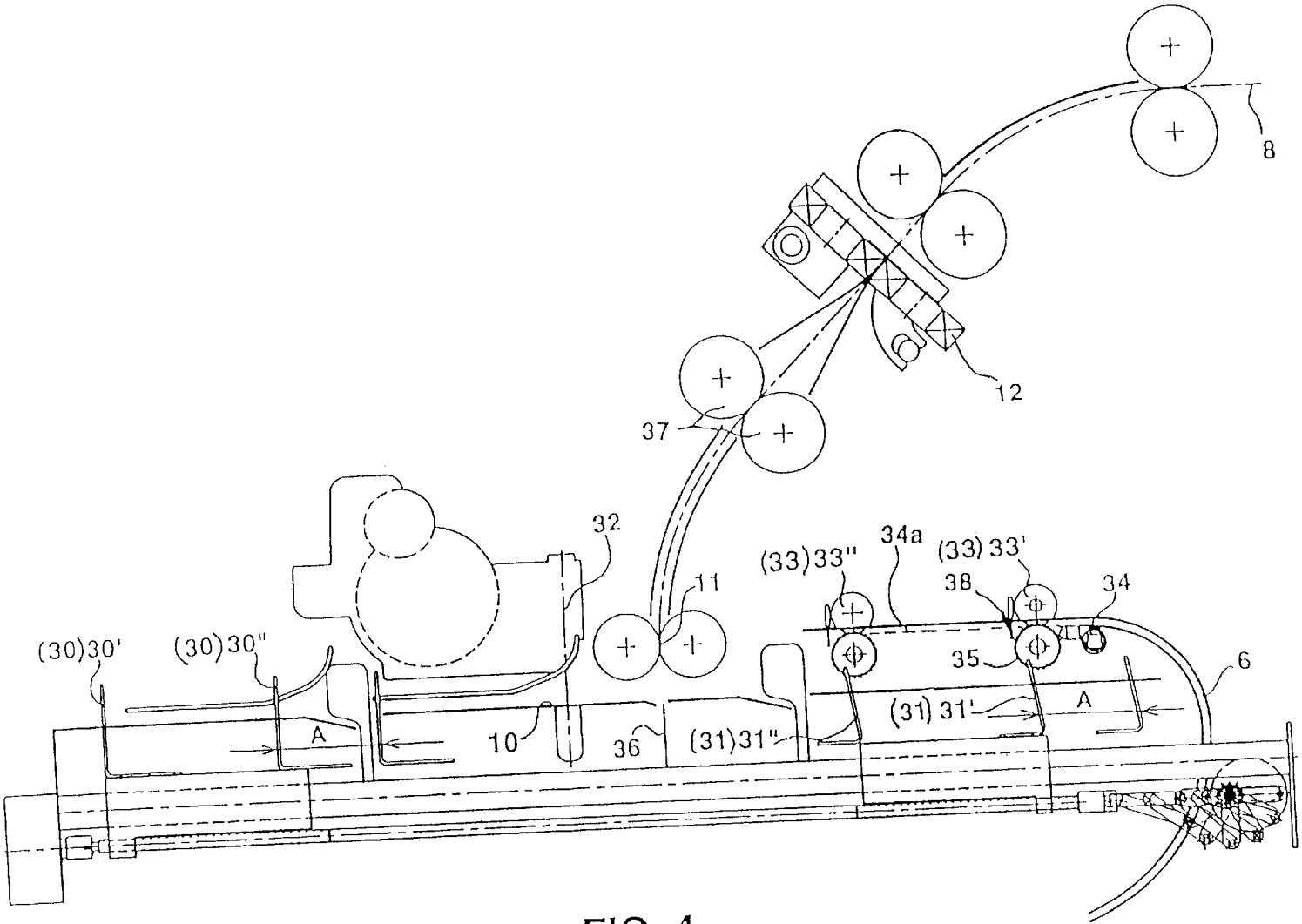
FIG. 4 is an embodiment of the folding and creasing device shown in FIG. 1.

FIG. 4 shows an embodiment of the folding and creasing device 9. This device comprises a collecting tray 10 extending horizontally and adapted to collect copy sheets of different sheet formats, e.g. the European sheet formats A3 (420×297 mm), A4 (297×210 mm), format B4 (364×257 mm) and the American sheet formats ledger (432×279 mm), letter standard (279×216 mm) and legal standard (356×216 mm).

To adjust the collecting tray 10 to the different sheet formats, the tray 10 is provided with adjustable stops 30 and 31 which can be set at a distance from one another varying between the longest sheet format (a ledger with a length of 432 mm) and the shortest sheet format (a letter standard with a length of 279 mm).

For the supply of a number of sheets folded to form a booklet, stops 30 and 31 are set to a position such that the distance therebetween corresponds to the length of the sheets for folding and that two stapling heads 32 disposed next to one another above the collecting tray 10 are situated exactly in the center between the stops 30 and 31. In FIG. 4, the stops 30 and 31 are shown in their extreme positions (respectively 30' and 31' and 30" and 31"). A transport roller pair 33 which feeds the sheets for collection from the transport path 6 into the collecting tray 10 is adjustable together with the stop 31. In position 33' the roller pair 33 is set to the supply of the longest sheet format while in position 33" it is set to the supply of the shortest sheet format. In order to bridge the distance between the feed path 6 and the collecting tray in the position 33", an unrollable sheet guide belt system 34 is fixed at the end of the feed path 6, the belt end being fixed to the displacement mechanism for the transport roller pair 33. On displacement of the transport roller pair 33 from the position 33' to 33", the belt 34*a* unrolls to act as a bottom guide for the sheet. Sawtooth wheels 35 are mounted on the shaft of the bottom roller of the transport roller pair 33. On the passage of the trailing edge a sawtooth engages said edge and presses it down, being supported by a flexible flap 38 which firmly presses the trailing sheet edge against the sawtooth wheels.

After a maximum of, for example, 15 sheets has been collected between the adjusted stops 30 and 31, the two adjacent stapling heads 32 each press a staple from above, downwardly onto a center-line through the collected sheets. Stop 30 is then moved on over a distance A to the middle of the collecting tray 10. In FIG. 4 this is shown for the smallest sheet format for the stop 30 and for the largest sheet format for the stop 31. Stop 31 also moves over the same distance A so that the distance between the stops 30 and 31 remains the same. In the position now reached, the stapled sheets are situated with their staples exactly beneath the folding nip of the folding rollers 11. A folding knife 36 then moves up to press the sheets between the folding rollers 11 and thus fold them double on the staple line. The folded sheets are then fed to the creasing device by a pair of transport rollers 37. By interrupting the drive of the rollers 37, the folded sheets are stopped with their fold line on the creasing line. The distance between the collecting tray 10 and the creasing device 12 is larger than half the length of the maximum sheet format (half the length of the ledger size=½×432 mm=216 mm. Thus with a booklet held fast in the creasing position a start can already be made in collecting sheets belonging to a following booklet. The transport roller pair 37 is disposed at a distance in front of the creasing device 12, shorter than one-half the length of the smallest sheet format (half the letter standard length=½×279 mm=139.5 mm), but preferably as small as possible so that during creasing a booklet is stopped as close as possible to the creasing line, e.g. at a distance of 86 mm in front of the creasing line.

Figure 6:
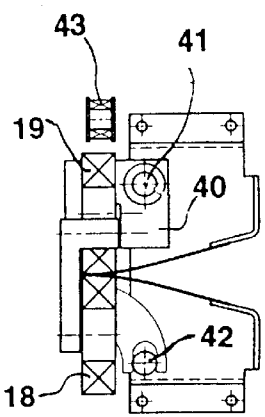
FIG. 6 is a cross-section of the embodiment of the creasing device shown in FIG. 4.
Figure 5:
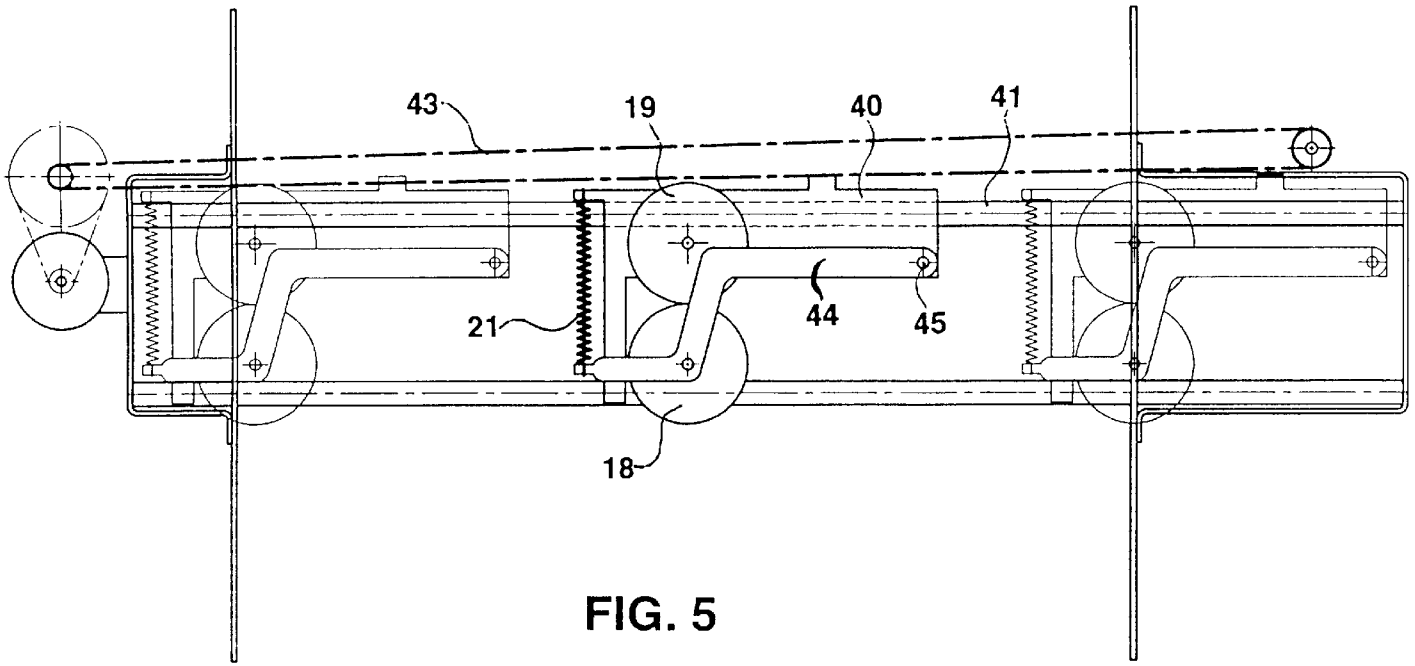
FIG. 5 is a longitudinal section of the embodiment of the creasing device shown in FIG. 4.

FIGS. 5 and 6 show an embodiment of a creasing device 12 in which the creasing roller 19 is rotatably secured to a slide 40, movable by a linear rolling bushes guide 41 between end positions shown in FIG. 5 and an operative position therebetween.

Turning the slide 40 about the axis of guide 41 is prevented by a fork-shaped guide 42. A belt drive 43 coupled to the slide 40 provides translatory movement of the slide 40. Creasing roller 18 is rotatably secured to an S-shaped arm 44 situated at one end 45 on the same side of the creasing line as the creasing roller 19, and rotatably secured to the slide 40. Arm 44 extends from end 45, first on the same side of the creasing line as creasing roller 19 and then passes the creasing line at the site of the creasing nip. As a result, the transport path for a flattened booklet is obstructed as little as possible by the slide moving in translation.

A suitable period of time for creasing a booklet as a result of the reciprocating movement of the creasing nip over the fold edge is 1 second.

The invention being thus described, it will be obvious that the same may be varied in many ways, such variations are not to be regarded as a departure from the spirit and scope of the invention, and all such modifications as would be obvious to one skilled in the art are intended to be included in the scope of the following claims.

What is claimed is:

1. A device for creasing a product comprising a plurality of sheets folded along a fold line so as to flatten the folded product, the device comprising:

folding means for initially folding an unfolded product to create the fold lines, nip-forming means for forming a creasing nip on the fold line and transport means for producing a relative movement between the formed creasing nip and the folded product along the fold line, wherein the transport means are provided with reversing means which, after displacement of the creasing nip along the fold line over the folded product in a first direction parallel to the fold line, whereby one or more sheets of the folded product are shifted in the said first direction, is operable to displace the creasing nip along the fold line over the folded product in a direction parallel to the fold line opposite to the first direction such that the shift is negated by the movement of the creasing nip in the opposite direction.

2. The device according to claim 1, wherein the nip-forming means are formed by at least one first roller adapted to roll along the fold line of a folded product.

3. The device according to claim 2, wherein the nip-forming means includes a second roller which forms a nip with the first roller for creasing the folded product on its fold line.

4. The device according to claim 3, wherein the creasing device comprises a fixed guide strip which extends through the creasing nip formed by the nip-forming rollers, a folded product disposed within said guide strip and adapted to be brought with its fold line into the creasing nip disposed on the side of the guide strip remote from the nip-forming rollers.

5. The device according to claim 4, wherein the guide strip is practically immovable in the creasing nip, in a direction parallel to the direction in which the axis of the nip-forming roller extends and is movable in a direction perpendicular to the flat plane traversed by the creasing nip.

6. The device according to claim 5, wherein the guide strip, in a direction in which the creasing nip is movable has a dimension larger than the longest fold line of a folded product for creasing and in that the maximum distance over which the creasing roller is adapted to roll over the guide strip corresponds to said larger dimension.

7. The device according to claim 6, wherein the guide strip forms an acute angle with the direction of the axis of the creasing roller in the direction parallel to the direction in which the axis of the nip-forming roller extends.

8. The device according to claim 7, wherein the guide strip is formed by a sheet of spring steel.

* * * * *